US012800260B2

(12) United States Patent
Cicchelli

(10) Patent No.: US 12,800,260 B2
(45) Date of Patent: Nov. 17, 2026

(54) PROLATE SPHEROID BUTT STOCK FOR FIREARM STABILIZATION

(71) Applicant: Carlos Cicchelli, Sheridan, WY (US)

(72) Inventor: Carlos Cicchelli, Sheridan, WY (US)

(73) Assignee: Ideas To Move Forward LLC, Sheridan, WY (US)

( * ) Notice: Subject to any disclaimer, the term of this patent is extended or adjusted under 35 U.S.C. 154(b) by 0 days.

(21) Appl. No.: 19/410,656

(22) Filed: Dec. 5, 2025

(65) Prior Publication Data

US 2026/0092758 A1 Apr. 2, 2026

Related U.S. Application Data

(63) Continuation-in-part of application No. 18/808,228, filed on Aug. 19, 2024, now Pat. No. 12,492,882.

(51) Int. Cl.
*F41C 23/08* (2006.01)
*F41C 23/14* (2006.01)

(52) U.S. Cl.
CPC ..... *F41C 23/14* (2013.01)

(58) Field of Classification Search
CPC ..... F41C 23/14; F41C 23/04; F41C 23/20; F41C 23/06; F41C 23/22; F41C 23/02; F41A 3/84
See application file for complete search history.

(56) References Cited

U.S. PATENT DOCUMENTS

| | | | | |
|---|---|---|---|---|
| 3,226,872 | A * | 1/1966 | Pachmayr | F41C 23/02 42/85 |
| 3,324,588 | A * | 6/1967 | Gilbert | F41C 23/00 42/71.01 |
| 6,370,806 | B1 * | 4/2002 | Klebes | F41A 19/58 42/84 |
| 6,637,141 | B1 * | 10/2003 | Weatherby | F41C 23/06 42/75.03 |
| 7,640,690 | B2 * | 1/2010 | Hines | F41C 23/16 42/84 |
| 7,823,313 | B2 * | 11/2010 | Faifer | F41C 23/06 42/1.06 |
| 7,849,626 | B2 * | 12/2010 | Fluhr | F41C 23/04 42/73 |
| 8,191,299 | B2 * | 6/2012 | Faifer | F41C 23/06 42/71.01 |
| 8,341,867 | B2 * | 1/2013 | Criswell | F41C 23/14 42/73 |
| 8,555,541 | B2 * | 10/2013 | Ingram | F41A 11/00 42/74 |
| 8,656,622 | B2 * | 2/2014 | Peterson | F41C 23/14 42/75.03 |
| 8,677,669 | B1 * | 3/2014 | Vesligaj | F41C 23/04 42/75.01 |
| 8,950,099 | B2 * | 2/2015 | Rogers | F41C 23/04 42/71.01 |
| 9,109,855 | B1 * | 8/2015 | Kincel | F41C 23/20 |
| 9,429,387 | B1 * | 8/2016 | Barfoot | F41C 23/20 |
| 9,784,526 | B2 * | 10/2017 | Chow | F41C 23/06 |
| 10,260,837 | B1 * | 4/2019 | McGinty | F41A 3/84 |

(Continued)

*Primary Examiner* — Michael D David
(74) *Attorney, Agent, or Firm* — Jonathan Hobbs

(57) ABSTRACT

The disclosure is related to a butt stock for a firearm, the butt stock having a prolate spheroid body, the butt stock configured and sized to attach to a buffer tube of a firearm, and capable of conforming to any part of a firearm operators' body.

12 Claims, 7 Drawing Sheets

(56) References Cited

U.S. PATENT DOCUMENTS

| | | | | |
|---|---|---|---|---|
| 12,173,984 | B2 * | 12/2024 | Swistak | F41C 23/20 |
| 12,352,528 | B2 * | 7/2025 | Roberts | F41C 23/20 |
| 2010/0115817 | A1 * | 5/2010 | Faifer | F41C 23/04<br>42/71.01 |
| 2012/0186122 | A1 * | 7/2012 | Zamlinsky | F41A 19/10<br>42/71.01 |
| 2012/0272819 | A1 * | 11/2012 | Cottle | F41A 19/00<br>42/71.01 |
| 2014/0109452 | A1 * | 4/2014 | Baker | F41C 23/06<br>42/1.06 |
| 2016/0084612 | A1 * | 3/2016 | Robinson | F41C 23/14<br>42/73 |
| 2016/0282084 | A1 * | 9/2016 | Hollis | F41C 33/001 |
| 2025/0093127 | A1 * | 3/2025 | Palmer | F41C 23/04 |

* cited by examiner

PROLATE SPHEROID BUTT STOCK FOR FIREARM STABILIZATION

CROSS REFERENCE TO RELATED APPLICATIONS

This application is a continuation of U.S. application Ser. No. 18/808,228 filed Aug. 19, 2024, now U.S. Pat. No. 12,492,882.

BACKGROUND

The disclosure is related to a butt stock that is detachable from a buffer tube of a firearm and provides a system and a method of stabilizing with counter weights the weight distribution of the firearm.

SUMMARY

Modern firearms have incorporated advances in material engineering such as composite plastics for many different components of the firearm such as stocks, magazines, barrel housings, and even chamber and firing mechanisms. These advances in material components, which are often a significantly lighter material than traditional materials, have resulted in a problem of stabilizing the weight distribution of the firearm.

Additionally, modern magazines have a much higher capacity of ammunition than traditional magazines adding additional weight to the front end (e.g., barrel opening end) of the firearm. Furthermore, the change in magazine size has resulted in a disadvantage for utilizing the firearm under certain tactical conditions such as for example, when the firearm must be fired from a prone positon (e.g., horizontal or ground level position), the high-capacity magazine prevents the operator from firing the firearm in the traditional position (e.g., the firearm must be tilted at a 45 degree angle with respect to the operator to be fired from a horizontal ground position). Under these conditions, a traditionally shaped buttstock does not provide stable positioning against the body of the operator for accurately operating the firearm, which can endanger the operator and result in injury to the firearm operator as the shape of traditional butt stocks do not allow the butt stock to be firmly positioned against the shoulder of the firearm operator. Furthermore, certain tactical conditions require the operator to utilize the weapon under time constraints that don't allow the operator to raise the weapon to a shoulder position where traditionally shaped butt stocks are meant to be utilized.

What is necessary is a butt stock which provides systems and methods for stabilizing the operation of the firearm by providing a shape that conforms to the firearm operator's body when the firearm is being operated at any angle and/or position on the operator's body and simultaneously provides a system for balancing the firearm while in operation.

DETAILED DESCRIPTION

The following detailed description and figures are merely example embodiments and are not intended to limit the disclosure to any particular embodiment provided herein. It is to be understood that there may be a variety of alternate embodiments not provided in the figures. The figures are not necessarily to scale, and some features may be excluded, altered in size or shape in order to show details of particular components. Specific structural and functional details and the materials utilized for the structural and functional details disclosed herein are not to be interpreted as limiting, but merely as a basis for teaching one skilled in the art to employ the varying embodiments of the present disclosure.

Figure 1:
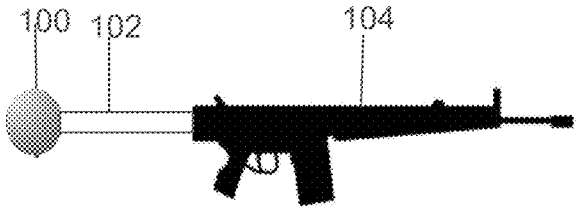
FIG. 1 is a perspective view of the butt stock attached to a firearm.

FIG. 1 is one possible embodiment showing a perspective view of the butt stock 100 attached to a buffer tube 102 of a firearm 104. It is important to note that this particular firearm 104 may be an AR-15, a typical firearm that would utilize this embodiment of the butt stock 100 shown in FIG. 1, however, there are many similar models of firearms such as the M4 that have similar buffer tubes to which the butt stock 100 can be attached and the embodiments described herein are not limited to any particular firearm. In some embodiments the butt stock 100 may be configured and sized to slide onto the buffer tube 102 of the firearm 104. In some embodiments, the butt stock 100 may be configured with a fastener to fasten the butt stock 100 to the buffer tube 102. A typical fastener that may fasten the butt stock 100 to the buffer tube 102 may be a threaded fastener, a lock pin fastener, a cam fastener, a magnetic fastener, or any similar type of fastener capable of fastening the butt stock 100 to the buffer tube 102.

In a typical firearm, the buffer tube is cylindrical in shape and has a set of slots arranged in a lower portion of the buffer tube for receiving a locking pin to lock the butt stock 100 into place. The set of slots allow for an adjustment of the butt stock position in relation to the operator and the firearm, lengthening or shortening the overall length (e.g., the pull) of the firearm. Typically, there are four slots arranged in half inch increments on the buffer tube 102 allowing for four inches of adjustment of the length of the weapon. In some embodiments the butt stock 100 may be configured with a locking pin mechanism to lock the butt stock 100 to the buffer tube 102.

In some embodiments the buffer tube 102 may be configured with an anti-rotation rail positioned at a top portion and/or a lower of the buffer tube to prevent the butt stock 100 from rotating out of alignment with the firearm 104. In some embodiments the butt stock 100 may be configured with an anti-rotation rail to prevent rotation of the butt stock 100 on the buffer tube 102. In some embodiments the butt stock 100 may be configured with an anti-rotation receiving slot to prevent the rotation of the butt stock 100.

Figure 2:
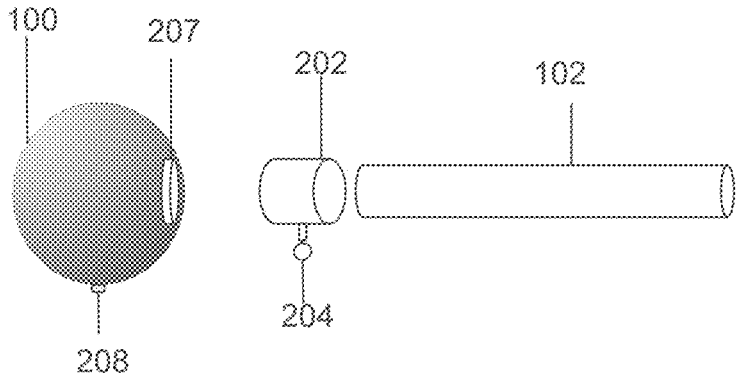
FIG. 2 is a perspective view of the butt stock detached from the firearm buffer tube.

FIG. 2 is a perspective view of one possible embodiment of the butt stock 100 configured with a receiving member 207, a receiving bore 202 detached from the buffer tube 102. In some embodiments the butt stock 100 may be configured to be fastened to a receiving bore 202 sized appropriately to attach to the buffer tube 102 of the firearm. This configuration may increase the pull length of the firearm. Buffer tube 102 size may typically be 0.5 inches in diameter but may be larger or smaller depending on the firearm 104 to which the receiving bore 202 and the butt stock 100 is attached. In some embodiments the receiving bore 202 of butt stock 100 may have an internal dimension slightly larger than 0.5 inches. In some embodiments the receiving member 207 of the butt stock 100 may be configured to have an internal diameter slightly larger than 0.5 inches.

In some embodiments the receiving bore 202 may be configured with at least one lock pin 204 for securing the butt stock 100 to the buffer tube 102. The butt stock 100 is not limited to utilizing a lock pin mechanism to secure the butt stock 100 to the buffer tube 102, but may utilize any one of a threaded fastener, a pin, a twist lock, a cam lock, or any suitable fastener that secures the butt stock 100 to the buffer tube 102. A more detailed description of the lock pin 204 will be provided in the following paragraphs.

In some embodiments the butt stock 100 may be configured with a receiving member 207. The butt stock 100 may be fastened to the receiving bore 202 or it may be fastened to buffer tube 102 directly by a receiving member 207. In some embodiments the butt stock 100 may be molded to the receiving bore 202 or it may be attached by a fastener. In some embodiments the receiving member 207 of the butt stock 100 may be sized to slide onto the receiving bore 202 and/or the buffer tube 102. In some embodiments the butt stock 100 may be sized appropriately for an operator, the butt stock may be 1-2 inches in diameter, 2-3 inches in diameter, 3-4 inches in diameter, 4-5 inches in diameter, 5-6 inches in diameter, or may be sized according the intended use by the operator. In some embodiments the butt stock 100 may be configured to house additional internal components, a detailed description of which will be provided in the following paragraphs. In some embodiments, the aforementioned size configurations provides increased stability during operation when the firearm 104 is operated at 0° to 180° bi-directionally in relation to the operator's body as opposed to a traditional butt stock that is a narrow body aligned with a vertical plane of the firearm. During operation of the firearm 104, a traditionally shaped butt stock (e.g., a narrow strip vertically aligned with the firearm 104) is positioned in the shoulder cup of the operator. Under certain conditions (e.g., when the firearm 104 is operated while in the prone position) the operator is unable to stabilize the weapon in the shoulder cup due to a position of the magazine or other interferences. Under these conditions a butt stock 100 with a spherical shaped or spherical analogue shape provides an increased surface area for stabilization of the weapon on nearly any surface of the operator's body. In some embodiments, the butt stock 100 may be configured in a prolate spheroid shape, an oblong shape, a truncated icosahedrons and/or any similarly related three dimensional analog shape that provides stabilization of the weapon. In some embodiments the butt stock 100 may be configured with an attachment point 208. The attachment point 208 may provide a fastening point for fastening a sling or any similar component that would be fastened to the butt stock 100.

Figure 3:
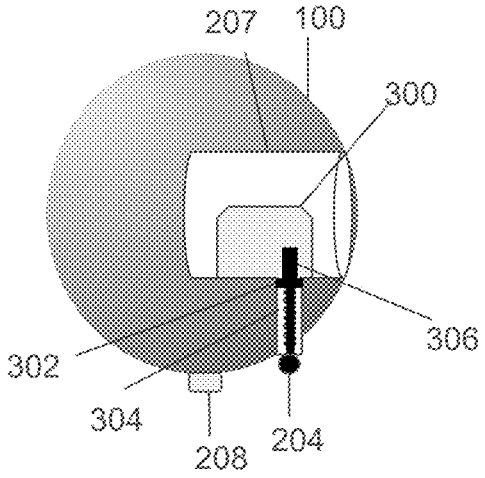
FIG. 3 is an exploded perspective view of the butt stock showing the locking pin mechanism for attaching the butt stock to the buffer tube of the firearm.

FIG. 3 is one possible embodiment of an exploded perspective view of the butt stock 100. In some embodiments the receiving member 207 of the butt stock 100 may be configured with a lock pin 204 capable of locking the butt stock 100 to the buffer tube 102. FIG. 3 is one possible embodiment showing the internal mechanisms of the lock pin 204 and the internal lock 300 of the buffer tube 102 for attaching the butt stock 100 to the buffer tube 102. In some embodiments, the lock pin 204 consists of a housing 302 a spring 304 and a pin 306. In some embodiments the butt stock 100 may be removed from the buffer tube 102 in the manner described hereafter. To remove the butt stock 100 from the buffer tube 102 the operator grasps the lock pin 204 and pulls away from the receiving member 207 compressing the spring 304 this action causes the pin 306 to retract from the buffer tube 102, the operator may then slide the butt stock 100 off the buffer tube 102.

In some embodiments the butt stock 100 may be securely fastened to the buffer tube 102 by a pin 306 that travels into the buffer tube 102. In some embodiments the butt stock 100 may be securely fastened to the buffer tube 102 by a threaded insert that fastens the butt stock 100 to the buffer tube 102. In some embodiments the butt stock 100 may be securely fastened to the buffer tube 102 by several lock pins or threaded insert configurations, a cam lock, a twist lock, or any combination thereof and is not limited to any one configuration described herein.

Figure 4:
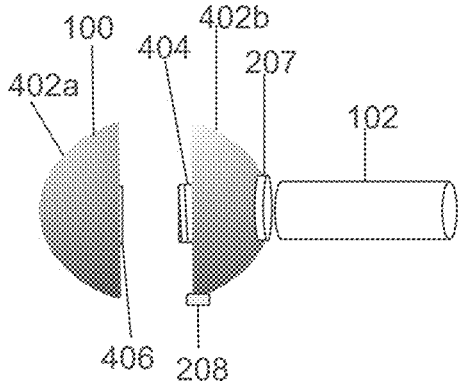
FIG. 4 is a perspective view of the rear shock absorption portion detached from the butt stock and the buffer tube of the firearm.

FIG. 4 is a perspective view of one possible embodiment of the spherical body of the butt stock 100 configured with a rear shock absorption portion 402*a* detached from the front portion 402*b*. In some embodiments the spherical body of the butt stock 100 may be configured with a rear shock absorption portion 402*a* and a front portion 402*b*. The rear shock absorption portion 402*a* may be configured with a threaded receiving insert 406 positioned at a center of position of the rear shock absorption portion 402*a* sized to receive a threaded rear bore 404 positioned to extend from a center portion of the front portion 402*b*. The disclosure is not limited to a threaded fastener to attach the rear shock absorption portion 402*a* to the front portion 402*b* but may be fastened by a twist lock cam lock or any combination of fastener capable of securely fastening the rear shock absorption portion 402*a* to the front portion 402*b*.

Figure 5:
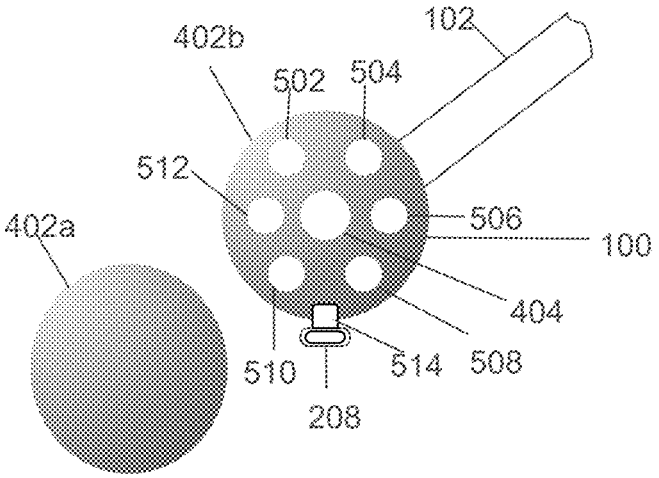
FIG. 5 is a rear perspective view of the detached rear shock absorption portion and counter weight receiving portion of the butt stock.

FIG. 5 is a rear perspective view of the butt stock 100 showing the rear shock absorption portion 402*a* detached from the front portion 402*b* and counter weight receiving portion positioned along the radius of the threaded rear bore 404. In some embodiments the front portion 402*b* may be configured with a number of counter weight receiving portions for example, counter weight receiving portion 502, counter weight receiving portion 504, counter weight receiving portion 506, counter weight receiving portion 508, counter weight receiving portion 510, counter weight receiving portion 512, positioned along the interior of the threaded rear bore 404.

In some embodiments the counter weight receiving portion may be configured in any shape such as for example a singular cavity that is positioned along the radius of the threaded rear bore 404, or any suitable configuration capable of receiving a counter weight. In some embodiments the attachment point 208 is fastened by a threaded member 514 to the front portion 402*b* of the butt stock 100. In some embodiments the attachment point 208 may be molded into the front portion 402*b* during manufacture or it may be attached to the front portion 402*b* in any combination thereof that securely fastens the attachment point 208 to the front portion 402*b*.

Figure 6:
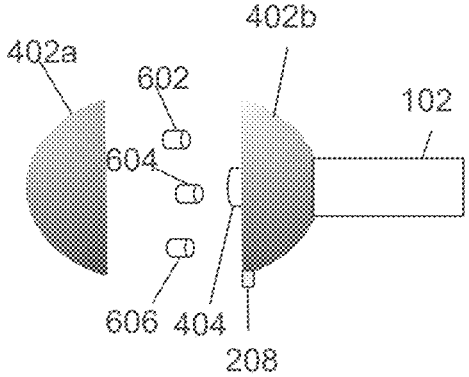
FIG. 6 is a perspective view of the rear shock absorption portion detached from the butt stock, the counter weights and the buffer tube of the firearm.

FIG. 6 is a perspective view of the rear shock absorption portion 402*a* detached from the front portion 402*b*, example counter weights are shown positioned to be inserted into the respective counter weight receiving portion of the front portion 402*b*. In some embodiments the front portion 402*b* may be configured to receive counter weight 602 counter weight 604 and counter weight 606 respectively in counter weight receiving portion 502, counter weight receiving portion 504, counter weight receiving portion 506 respectively positioned along an interior portion of the threaded rear bore 404.

The counter weight 602, counter weight 604, and counter weight 606 may be configured in any shape and not limited to the shape illustrated in FIG. 6. The counter weight may be selected from any material such as brass, copper, lead, aluminum, stainless steel 304/304L or any combination of any material capable of providing a counterbalance to stabilize the balance of the firearm. In some embodiments for example, a lead counter weight (e.g., Pb) of 1 cubic inch in a cylindrical shape weighs approximately 146 grams. In the example embodiment the front portion 402*b* is configured with six counter weight receiving portions which would have a combined counterbalance weight of approximately 876 grams. In some embodiments for example a material of stainless steel 304/304L may be utilized as a counter weight, one cubic inch would weigh approximately 132 grams, the combined total of six cylindrical counter weights in the dimensions described would be 792 grams. In some embodiments the counter weight could be formed in any shape or size to fit into the front portion 402*b* of the butt stock 100 for example, the counter weight could be formed in a sphere shape, a cube shape, or any shape that could be utilized in the butt stock 100.

In some embodiments the rear shock absorption portion 402*a* may be configured to house the counter weight 602, counter weight 604, and counter weight 606 in a configuration similar to front portion 402*b* as described above. In some embodiments, the firearm 104 configured with at least one counter weight 602 in the butt stock 100 may be placed in a device to determine a balance of the firearm 104. In some embodiments the device for determining the balance of the firearm 104 (not shown in the figures) may be configured as a base having a main member extending vertically from the base, the main member may be configured with a u-shaped member positioned at the opposing end of the main member extending away from the main member. In some embodiments the firearm 104 may be placed in the u-shaped member at a midpoint (e.g., near the trigger and/or hand grip of the firearm) of the firearm to determine a balance. In the instance where the firearm 104 placed in the u-shaped member is determined to be heavier at the butt stock 100 end, the operator may remove at least one counter weight. In the instance where the firearm 104 is determined to be heavier at the barrel opening side the operator may add at least one additional counter weight to the butt stock 100. In some embodiments the operator may use a sandbag or any stable surface capable of providing a surface for determining the balance of the firearm 104.

Figure 7:
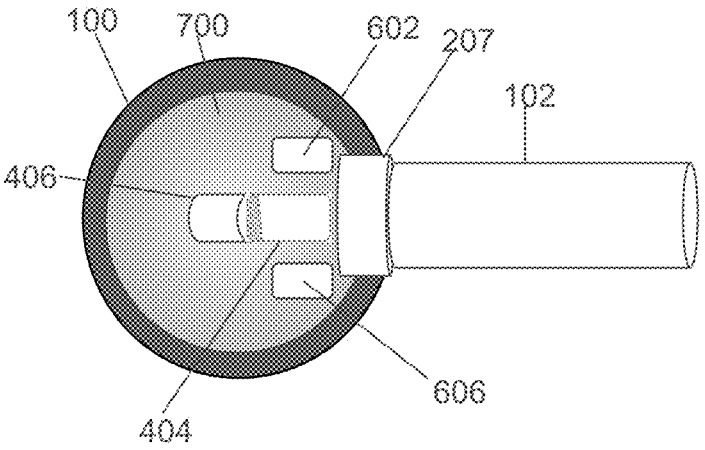
FIG. 7 is an exploded perspective of the rear portion of the butt stock, the threaded receiver bore and counter weights mounted in the butt stock.

FIG. 7 is an exploded perspective of the internal components 700 of the butt stock 100, the threaded rear bore 404, counter weight 602, and counter weight 606 mounted in the butt stock 100, the receiving member 207 attached to the buffer tube 102 of the firearm 104. In some embodiments, the counter weight 602 and counter weight 606 securely mount in the front portion 402*b* by the threading the threaded receiving insert 406 of the rear shock absorption portion 402*a* into the threaded rear bore 404 of the front portion 402*b*. In some embodiments the rear shock absorption portion 402*a* is secured to the front portion 402*b* by the threaded receiving insert 406 threaded into the threaded rear bore 404. The disclosure is not limited to the above described configurations but may be configured in any manner that provides sufficient balance and stabilization of the firearm 104.

The present disclosure is well adapted to carry out the objectives and achieve both the results and advantages described above, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only by the spirit and scope of the claims, giving full cognizance to equivalents in all respects.

With the foregoing description, the disclosure herein has described the subject matter of the following numbered clauses:

Clause 1. A detachable butt stock for a firearm including a spherical body having a receiving member configured and sized to attach to a protruding buffer tube of the firearm.

Clause 2. The detachable butt stock of clause 1, the spherical body configured with a rear shock absorption portion that is detachable from a front portion.

Clause 3. The detachable butt stock of clause 2, the rear shock absorption portion and the front portion configured with a fastener capable of fastening the front portion and the rear shock absorption portion.

Clause 4. The detachable butt stock of clause 3, the front portion configured with a counter weight receiving portion positioned along an interior portion of the front portion.

Clause 5. The detachable butt stock of clause 4, the counter weight receiving portion configured in spaced portions along the interior portion.

Clause 6. The detachable butt stock of clause 3, the rear shock absorption portion configured with a counter weight receiving portion positioned along an interior portion of the rear shock absorption portion.

Clause 7. The detachable butt stock of clause 4, the counter weight receiving portion configured in spaced portions along the interior portion.

The invention claimed is:

1. A detachable buttstock for a firearm comprising:

a prolate spheroid body having a minor axis 1 to 6 inches in diameter and a major axis 1 to 6 inches in diameter capable of conforming to any position of a firearm operators' body with which the buttstock is in contact having a receiving member configured and sized to attach the detachable buttstock to a protruding buffer tube of a firearm.

2. The detachable buttstock according to claim 1, the prolate spheroid body configured with a rear portion that is detachable by a fastener from a front portion.

3. The detachable buttstock according to claim 2, the rear portion and the front portion configured with a fastener capable of fastening the front portion and the rear portion.

4. The detachable buttstock according to claim 3, the front portion configured with at least one counter weight cavity positioned along an interior portion of the front portion that permits counter weight insertion into the front portion when the front portion is separated from the rear portion.

5. The detachable buttstock according to claim 4, the at least one counter weight cavity configured in spaced portions circumferentially about the threaded rear bore of the interior portion.

6. The detachable buttstock according to claim 3, the rear portion configured with at least one counter weight cavity positioned along an interior portion of the rear portion that permits counter weight insertion into the rear portion when the rear portion is separated from the front portion.

7. The detachable buttstock according to claim 4, the at least one counter weight cavity configured in spaced portions circumferentially about a receiving insert of the interior portion.

8. The detachable buttstock according to claim 1, the receiving member configured with an anti-rotation receiving portion.

9. The detachable buttstock according to claim 1, the prolate spheroid body configured with any one of a pin, threaded fastener, twist lock, or cam lock to secure the butt stock to the buffer tube.

10. A method comprising:

providing a detachable buttstock for a firearm having (i) a prolate spheroid body having a minor axis 1 to 6 inches in diameter and a major axis 1 to 6 inches in diameter capable of conforming to any position of an operator's body with which the buttstock is in contact;

(ii) a receiving member configured and sized to attach the detachable buttstock to a protruding buffer tube of a firearm;

(iii) a rear portion of the prolate spheroid body detachable from a front portion of the prolate spheroid body; and (iv) at least one counterweight cavity formed inside the prolate spheroid body;

attaching the buttstock to the buffer tube of the firearm;

supporting the firearm at a fulcrum point of the firearm;

observing whether the firearm is muzzle-heavy or buttstock-heavy;

removing the rear portion from the prolate spheroid body to expose the at least one counterweight cavity, if the firearm is muzzle-heavy, inserting at least one counterweight into the at least one of the counterweight cavity, and re-attaching the rear portion to the body;

removing the rear portion, removing at least one counterweight from the counterweight cavity if the firearm is buttstock-heavy, and re-attaching the rear portion; and repeating the supporting, observing, and counterweight adjustment steps as necessary until the firearm is substantially balanced about the fulcrum point.

11. The method of claim 10, the providing a detachable buttstock having the detachable rear portion having a shock-absorption portion on the rear portion.

12. The method of claim 10, the attaching the buttstock to the buffer tube of the firearm by any one of a pin, threaded fastener, twist lock, or cam lock to secure the butt stock to the buffer tube.

* * * * *